US009821574B2

(12) United States Patent
Fujimori

(10) Patent No.: US 9,821,574 B2
(45) Date of Patent: Nov. 21, 2017

(54) MEDIUM HOLDING DEVICE AND RECORDING APPARATUS

(71) Applicant: SEIKO EPSON CORPORATION, Tokyo (JP)

(72) Inventor: Naoyuki Fujimori, Shimosuwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/129,400

(22) PCT Filed: Mar. 25, 2015

(86) PCT No.: PCT/JP2015/001696
§ 371 (c)(1),
(2) Date: Sep. 26, 2016

(87) PCT Pub. No.: WO2015/146168
PCT Pub. Date: Oct. 1, 2015

(65) Prior Publication Data

US 2017/0106673 A1 Apr. 20, 2017

(30) Foreign Application Priority Data

Mar. 27, 2014 (JP) ..... 2014-065419

(51) Int. Cl.

| | |
|---|---|
| ***B41J 11/58*** | (2006.01) |
| ***B41J 11/06*** | (2006.01) |
| ***B41J 11/02*** | (2006.01) |
| *B41J 13/10* | (2006.01) |

(52) U.S. Cl.
CPC ..... *B41J 11/58* (2013.01); *B41J 11/02* (2013.01); *B41J 11/06* (2013.01); *B41J 13/10* (2013.01); *B41J 13/103* (2013.01)

(58) Field of Classification Search
CPC ... B41J 11/58; B41J 13/10; B41J 11/06; B41J 11/02; B41J 13/103; B41J 13/106
See application file for complete search history.

(56) References Cited

U.S. PATENT DOCUMENTS 6,622,953 B2 * 9/2003 Inana ..... B65H 16/06 242/348
2003/0197772 A1 * 10/2003 Iwatsuki ..... B41J 11/06 347/104

FOREIGN PATENT DOCUMENTS

JP 2003-312069 11/2003

OTHER PUBLICATIONS

ISR dated Jun. 5, 2015 for PCT/JP2015/001696.

* cited by examiner

*Primary Examiner* — Henok Legesse
(74) *Attorney, Agent, or Firm* — Workman Nydegger

(57) ABSTRACT

A medium holding device includes a large tray having a medium mounting surface; an intermediate tray having a medium mounting surface smaller than that of the large tray; a tray mounting section on which the large tray and the intermediate tray are selectively mounted; a frame body that holds a recording medium with the large tray if the large tray and the intermediate tray have separate configuration and the large tray is mounted on the tray mounting section; and a first attachment that is mounted on an inside of the frame body and holds the recording medium with the intermediate tray if the intermediate tray is mounted on the tray mounting section, and is separated from the frame body if the large tray is mounted on the tray mounting section.

11 Claims, 10 Drawing Sheets

[Fig. 1]
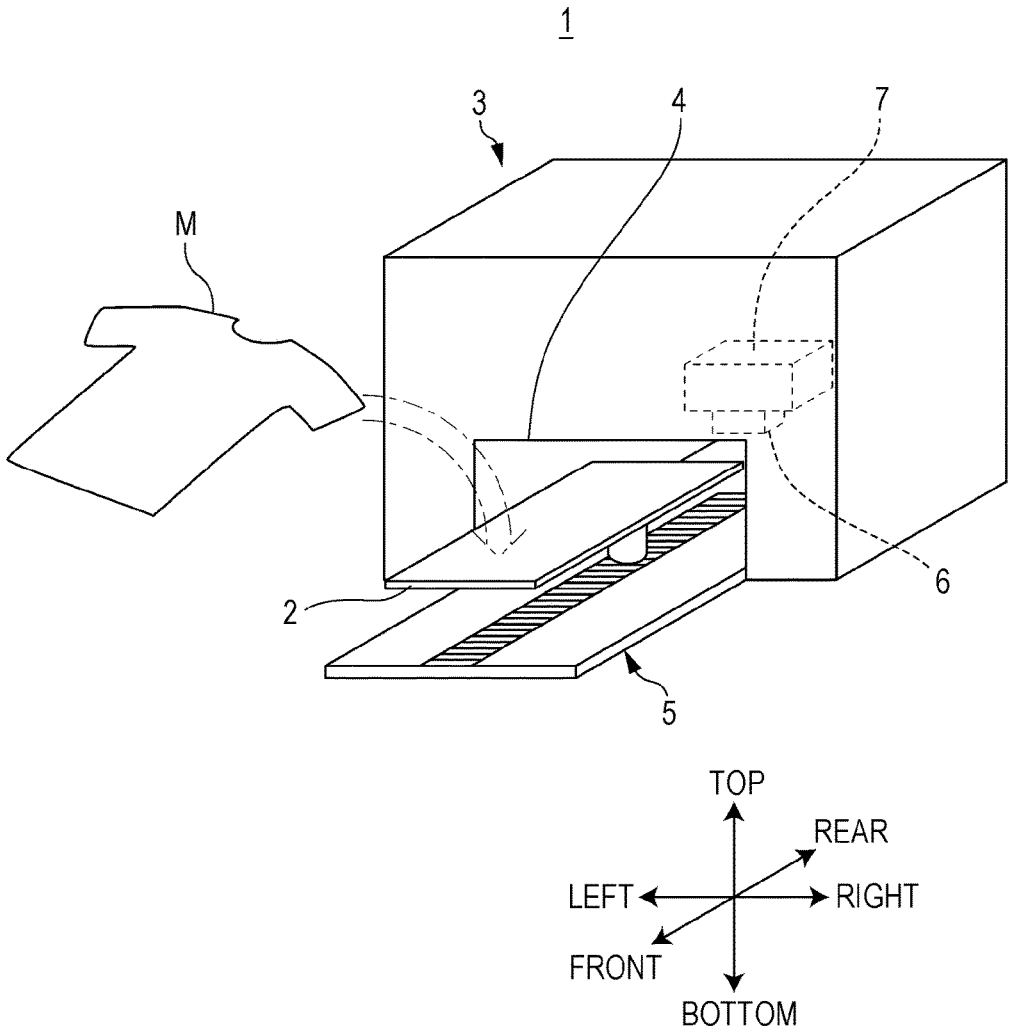

[Fig. 2]
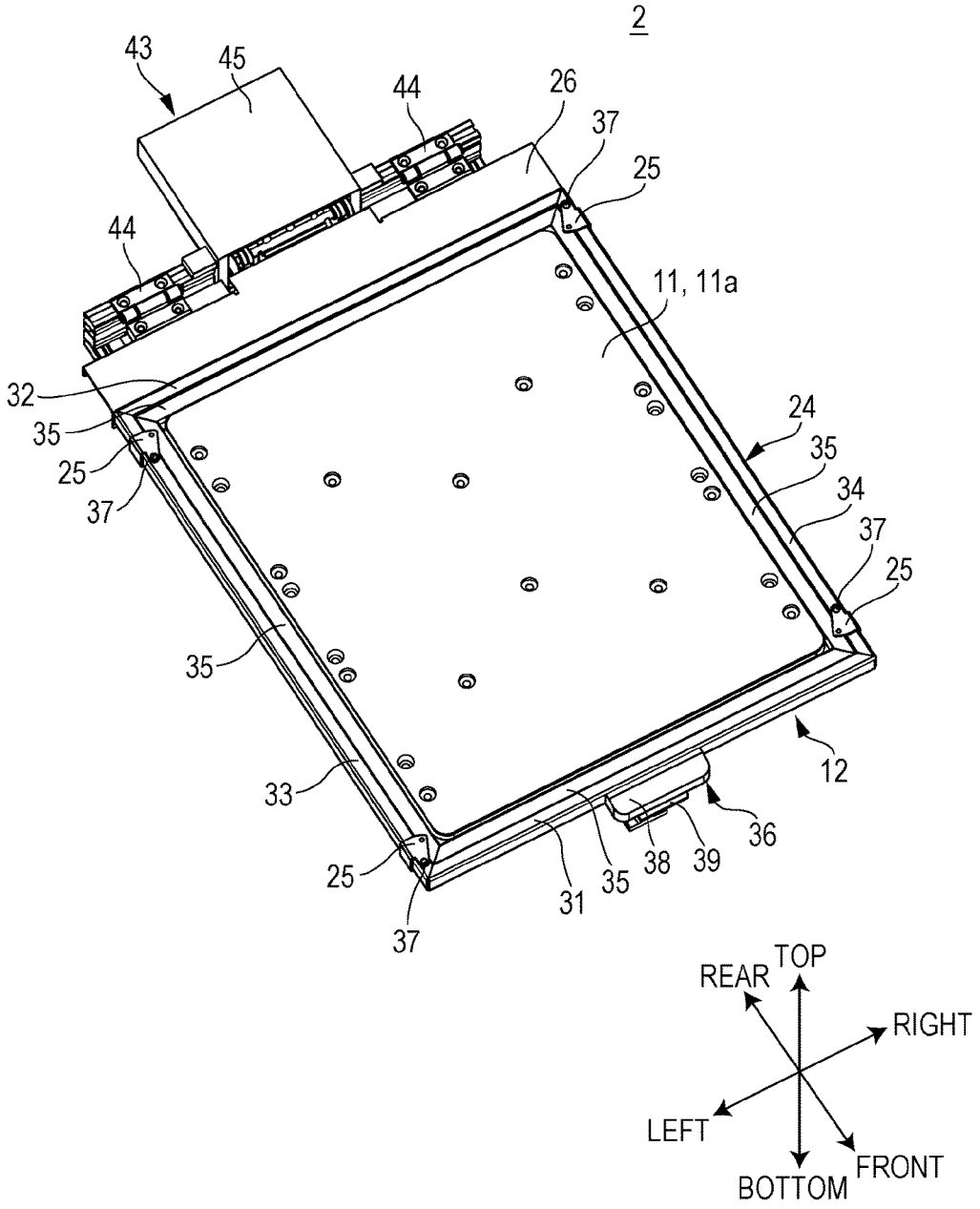

[Fig. 3]
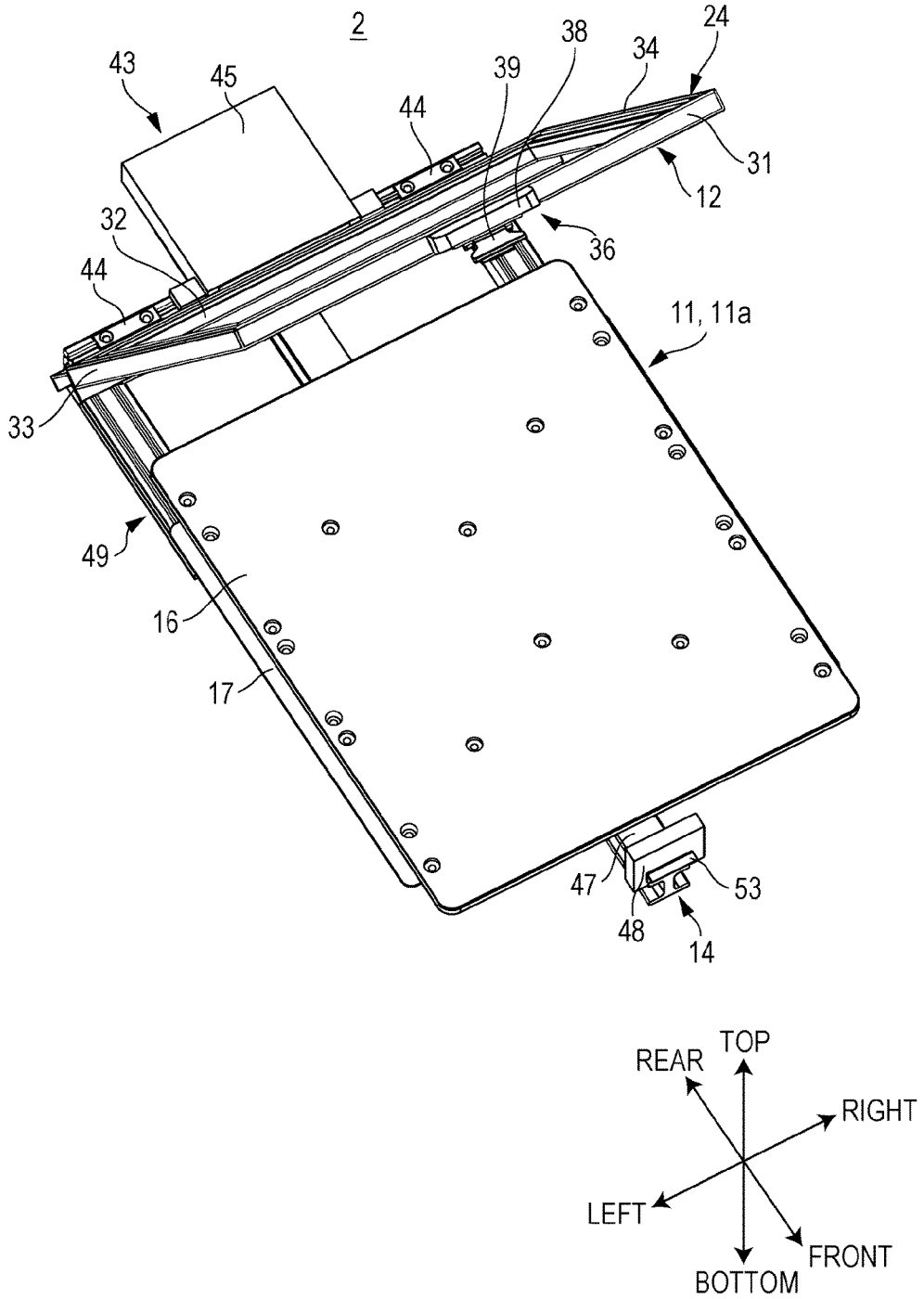

[Fig. 4]
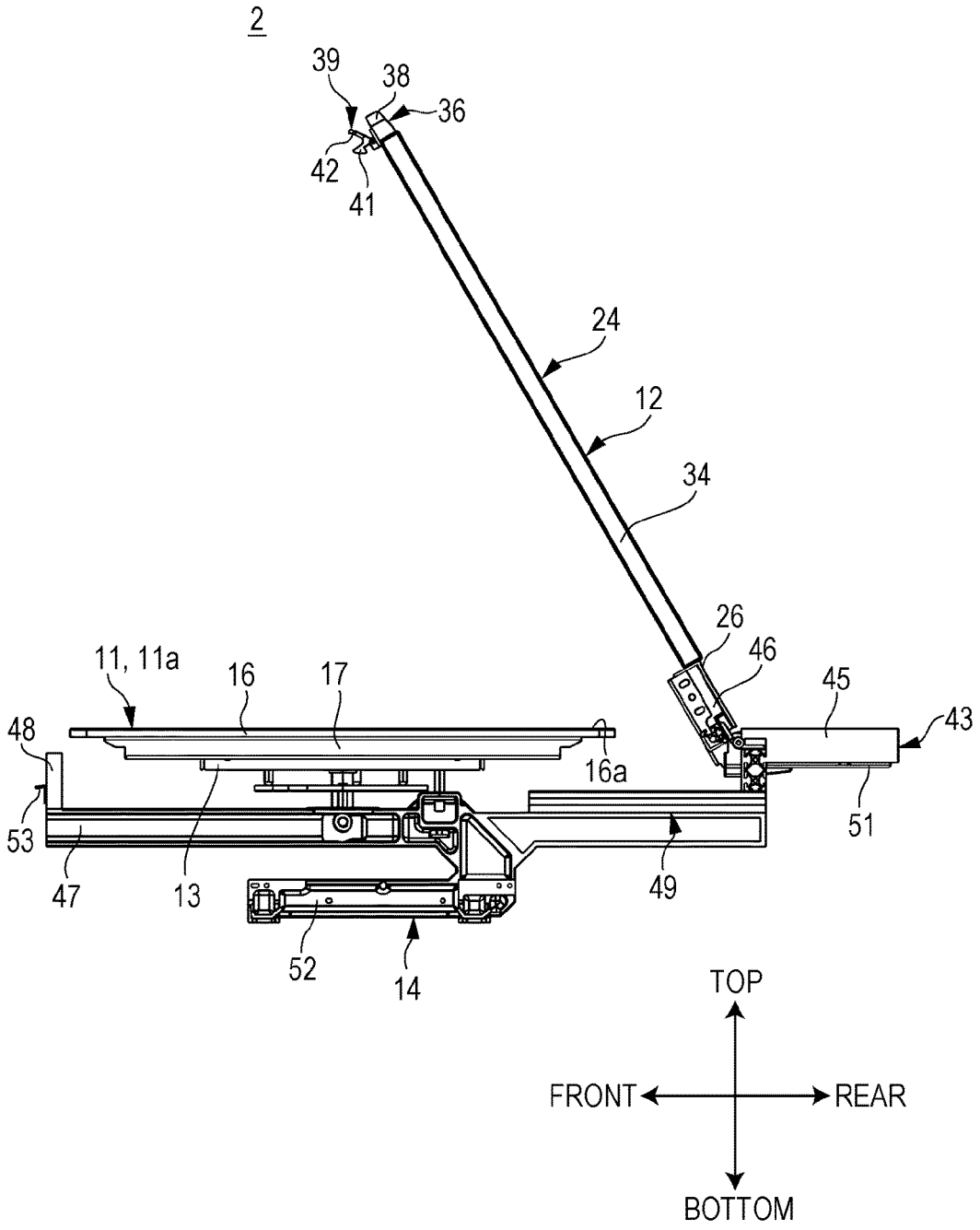

[Fig. 5A]
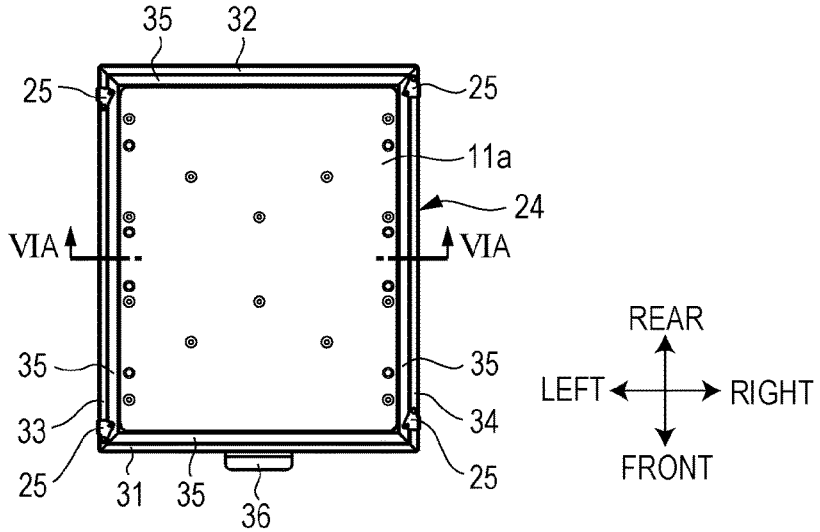
[Fig. 5B]
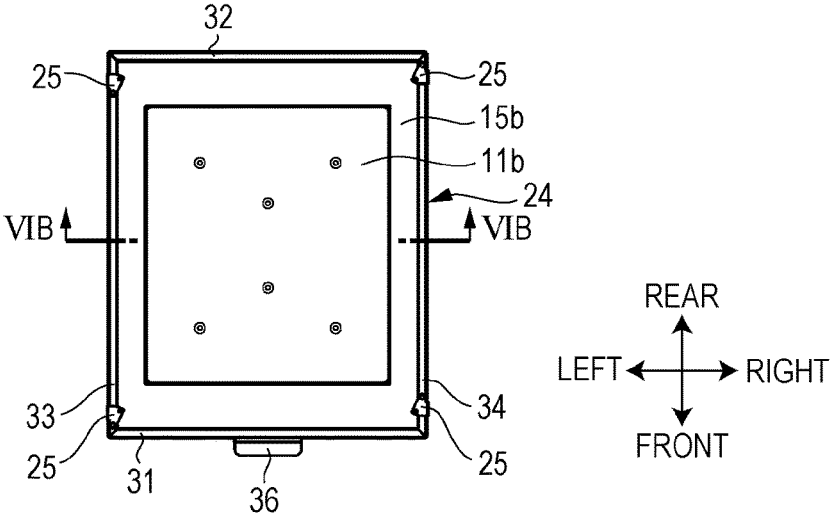
[Fig. 5C]
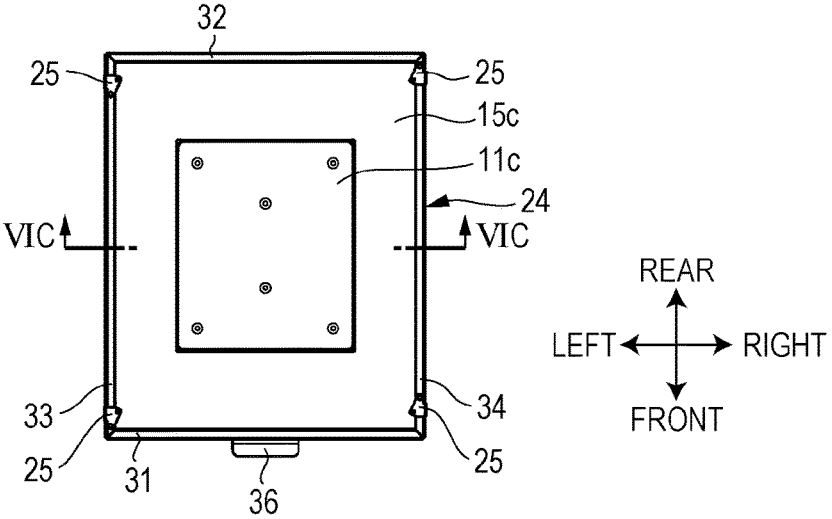

[Fig. 5D]
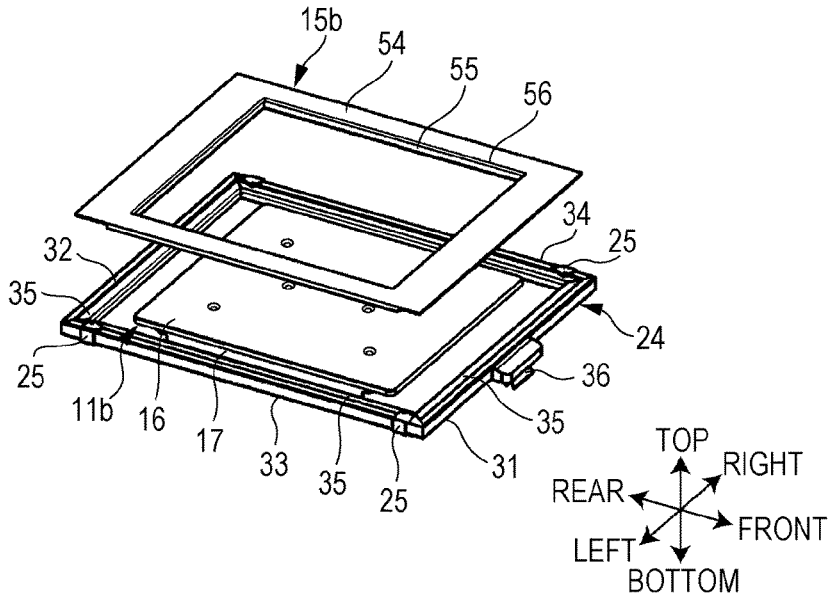
[Fig. 5E]
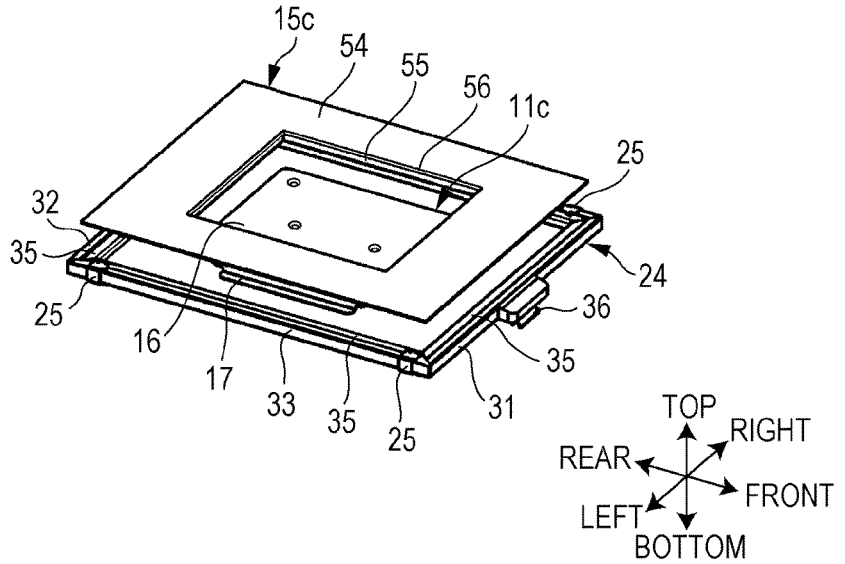

[Fig. 6A]
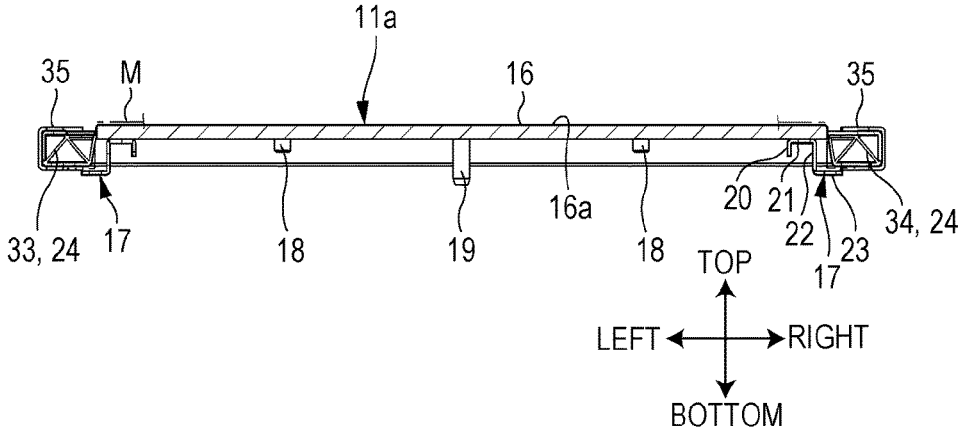
[Fig. 6B]
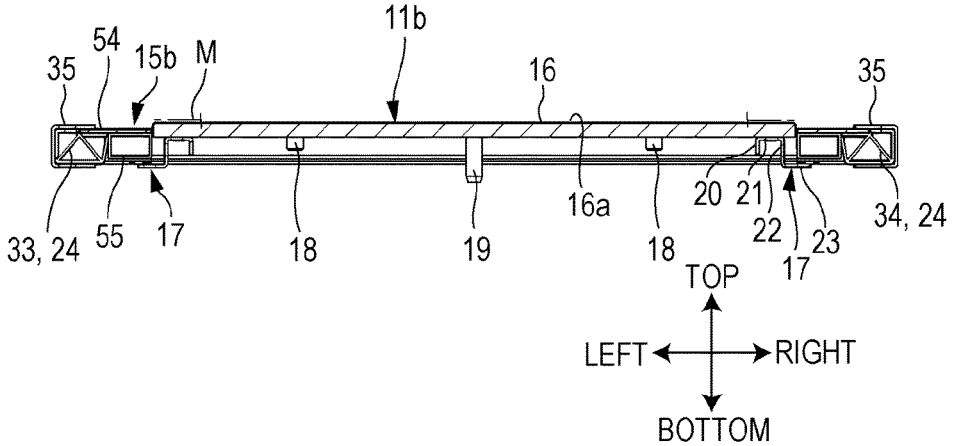
[Fig. 6C]
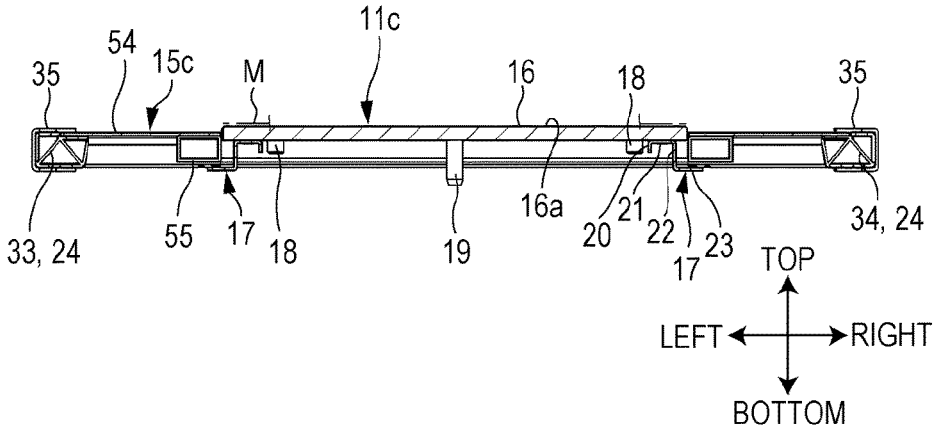

[Fig. 7]
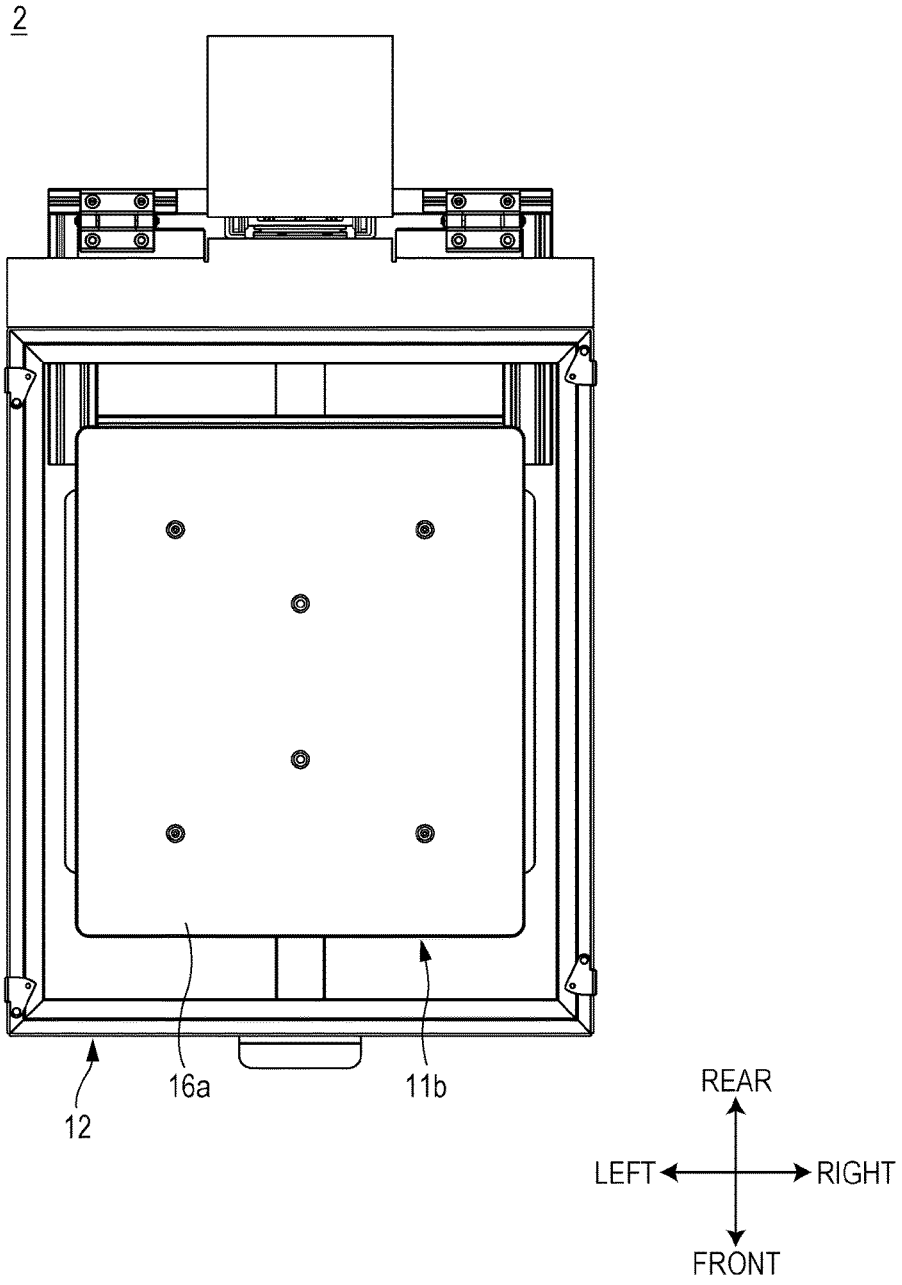

[Fig. 8]
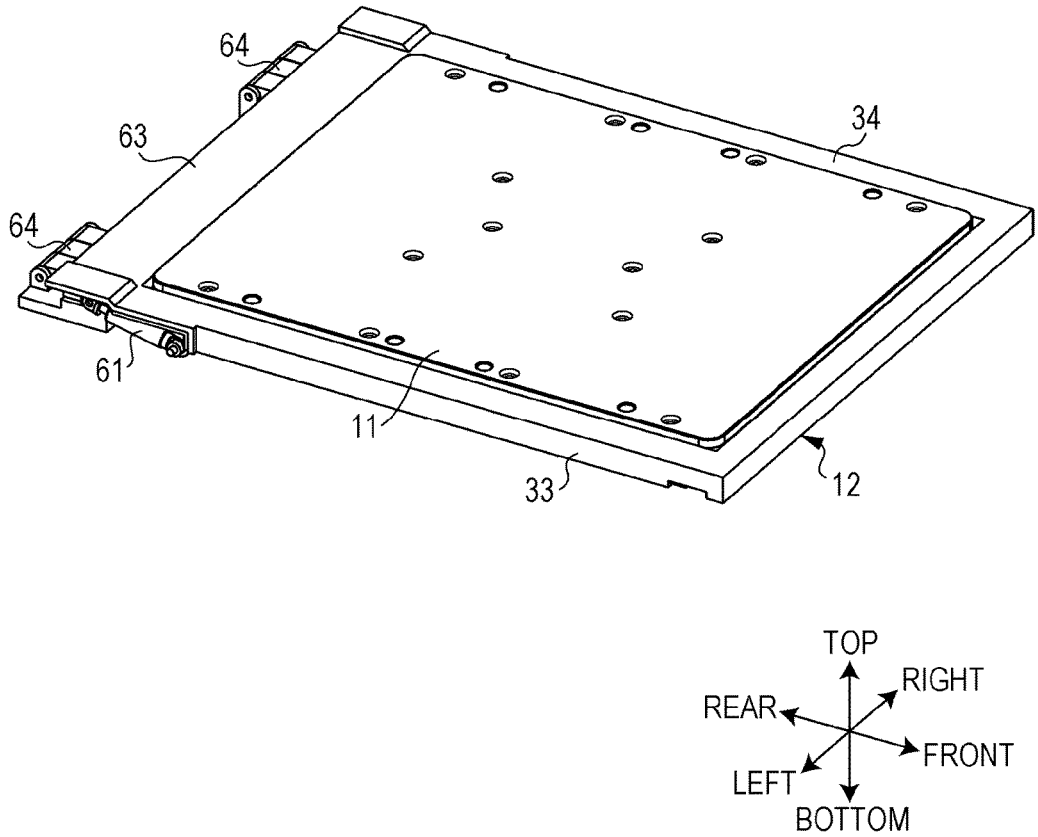

[Fig. 9]
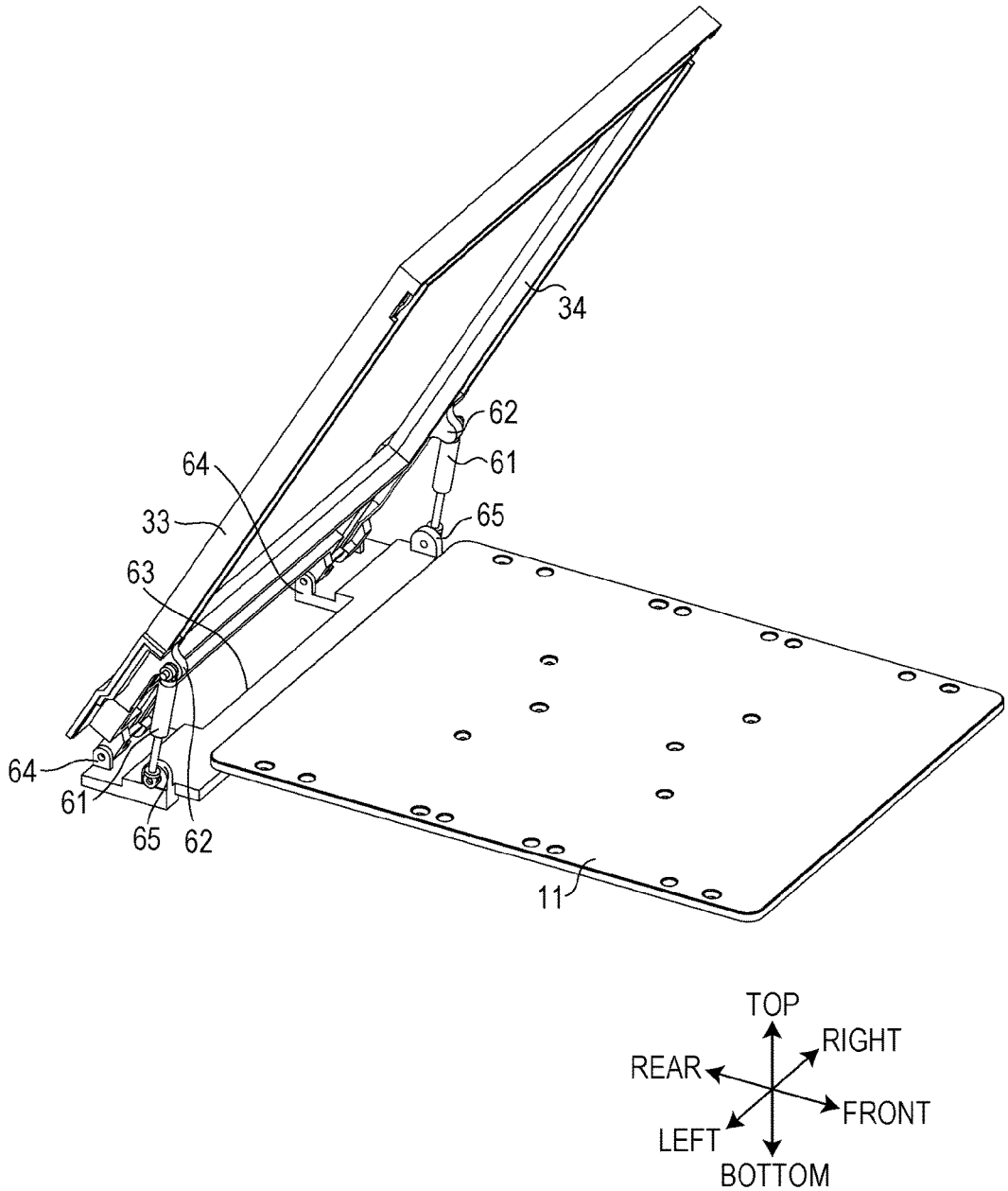

MEDIUM HOLDING DEVICE AND RECORDING APPARATUS

TECHNICAL FIELD

The present invention relates to a medium holding device that holds a recording medium on which an image is recorded and a recording apparatus.

BACKGROUND ART

In the related art, as a platen device mounted on an ink jet printer for recording an image on a medium to be printed such as T-shirts, a platen device is known which includes a platen on which the medium to be printed is mounted, a support plate that is disposed below the platen, a frame that pinches and holds the medium to be printed mounted on the platen together with the support plate, and a platen tray that is positioned below these members and houses a portion not mounted on the platen of the medium to be printed pinched by the frame so as to receive the portion. The platen device has a configuration in which the platen, the support plate, the frame, and the platen tray described above are integrally assembled with a bottom portion (see PTL 1).

CITATION LIST

Patent Literature

PTL 1: JP-A-2003-312069

SUMMARY OF INVENTION

Technical Problem

In such a platen device, a plurality of sizes of platens are prepared so as to correspond to media to be printed of various sizes and a user exchanges the platen according to the size of the medium to be printed. In the platen device of the related art, since the platen forms an integral structure with the frame, the platen is exchanged together with the frame and the like and if the size of the platen is large, the integral structure combined with the frame and the like is very heavy. Thus, exchange work of the platen is not easy.

Accordingly, it is an object of the present invention to provide a medium holding device in which a user can easily perform an exchange work of a tray and a recording apparatus.

Solution to Problem

A medium holding device of the invention includes a first tray that has a medium mounting surface; a second tray that has a medium mounting surface smaller than that of the first tray; a tray mounting section on which the first tray and the second tray are selectively mounted; a holding frame that is separately configured from the first tray and the second tray, and holds a recording medium on which an image is recorded and which is mounted on the medium mounting surface of the first tray with the first tray if the first tray is mounted on the tray mounting section; and an attachment that is mounted on an inside of the holding frame and holds the recording medium mounted on the medium mounting surface of the second tray with the second tray if the second tray is mounted on the tray mounting section, and is separated from the holding frame if the first tray is mounted on the tray mounting section.

According to this configuration, a user can mount a first set tray on the tray mounting section and hold the recording medium between the first set tray and the holding frame. Furthermore, the user can mount a second set tray on the tray mounting section and hold the recording medium between the second set tray and the attachment by mounting the attachment on the holding frame.

In this case, it is preferable that the medium holding device further includes a base section that supports the tray mounting section, in which the holding frame is provided in the base section to be rotatable between a holding position in which the recording medium is held and a non-holding position in which the holding of the recording medium is released.

According to this configuration, the user can hold and release the recording medium by the holding frame by performing a simple operation in which the holding frame is rotated between the holding position and the non-holding position. Thus, it is possible to hold the recording medium by the holding frame and to improve workability when releasing the recording medium.

In this case, it is preferable that the medium holding device further includes a frame-side lock section that is provided in the holding frame, and a base-side lock section that is provided in the base section and engages with the frame-side lock section of the holding frame positioned in the holding position.

According to this configuration, the holding frame is locked in the holding position by engaging the frame-side lock section with the base-side lock section. Then, since the same holding frame is shared for the first tray and the second tray, it is possible to reduce the number of frame-side lock sections without it being necessary to prepare a frame-side lock section for each holding frame as in a case where the holding frames are separately used for the first tray and the second tray.

In this case, it is preferable that the medium holding device further includes a brake assist section that is mounted on the holding frame and brakes rotation of the holding frame to the holding position and assists rotation of the holding frame to the non-holding position.

According to this configuration, it is possible to improve workability when rotating the holding frame between the holding position and the non-holding position.

In this case, it is preferable that the brake assist section is configured of an assist hinge rotatably connecting the holding frame to the base section.

According to this configuration, it is possible to mount the assist hinge closer to a rotation shaft of the holding frame than in a case of using a gas spring as the brake assist section. Thus, it is possible to reduce a size of the holding frame.

In this case, it is preferable that the first tray has a tray body in which one surface of front and rear surfaces is the medium mounting surface, and a guide section that is provided in an edge portion of a surface opposite to the medium mounting surface of the tray body and guides an end portion of the recording medium hanging from between the tray body and the holding frame to the outside with respect to the tray body.

According to this configuration, since the end portion of the recording medium hanging from between the tray body of the first tray and the holding frame is guided to the outside with respect to the tray body by the guide section, it is possible to increase a contact area between the tray body, the holding frame, and the recording medium. Thus, if the recording medium is held between the first tray and the holding frame, it is easy to extend wrinkles of the held recording medium and it is possible to prevent the recording medium from being moved after the recording medium is held.

In this case, it is preferable that the attachment has a plate section provided with an opening, and an attachment frame section that is provided along an edge portion of the opening in one surface of the front and rear surfaces of the plate section. It is preferable that the second tray has a tray body in which one surface of the front and rear surfaces is the medium mounting surface, and a guide section that is provided in the edge portion of the surface opposite to the medium mounting surface of the tray body and guides the end portion of the recording medium hanging from between the tray body and the attachment frame section to the outside with respect to the tray body.

According to this configuration, since the end portion of the recording medium hanging from between the tray body of the second tray and the attachment frame section of the attachment is guided to the outside with respect to the tray body by the guide section, it is possible to increase the contact area between the tray body, the attachment frame section, and the recording medium. Thus, if the recording medium is held between the second tray and the attachment, it is easy to extend wrinkles of the held recording medium and it is possible to prevent the recording medium from being moved after the recording medium is held.

In this case, it is preferable that the holding frame has a frame body in which an engaging section engaging with an outer peripheral edge of the attachment is provided in an inner peripheral edge thereof, and a locking member that is movably provided in the frame body between a locked position in which the attachment engaged with the engaging section is locked to the frame body and an unlocked position in which the locking of the attachment is released.

According to this configuration, the user can mount the attachment on the holding frame and separate the attachment from the holding frame by performing a simple operation in which the locking member is moved between the locked position and the unlocked position.

A recording apparatus of the invention includes the medium holding device described above and a recording section that records an image to the recording medium held by the medium holding device.

The recording section is not particularly limited and, for example, a recording section ejecting ink using an ink jet type recording section can be used.

BRIEF DESCRIPTION OF DRAWINGS

FIG. 1 is a perspective view of a recording apparatus according to an embodiment of the invention.

FIG. 2 is a perspective view of a medium holding section and is a view of a state where a holding frame is positioned in a holding position.

FIG. 3 is a perspective view of the medium holding section and is a view of a state where the holding frame is positioned in a non-holding position.

FIG. 4 is a right side view of the medium holding section and is a view of a state where the holding section is positioned in the non-holding position.

FIG. 5A is a plan view of the holding frame and a large tray.

FIG. 5B is a plan view of the holding frame on which a first attachment is mounted and an intermediate tray.

FIG. 5C is a plan view of the holding frame on which a second attachment is mounted and a small tray.

FIG. 5D is a perspective view of the holding frame, the intermediate tray, and the first attachment.

FIG. 5E is a perspective view of the holding frame, the small tray and the second attachment.

FIG. 6A is a cross-sectional view that is taken along a cutting line VIA-VIA of FIG. 5A.

FIG. 6B is a cross-sectional view that is taken along a cutting line VIB-VIB of FIG. 5B.

FIG. 6C is a cross-sectional view that is taken along a cutting line VIC-VIC of FIG. 5C.

FIG. 7 is a plan view of the holding frame from which the attachment is separated and the intermediate tray.

FIG. 8 is a perspective view of a medium holding section according to a modified example and is a view of a state where the holding frame is positioned in a holding position.

FIG. 9 is a perspective view of the medium holding section according to the modified example and is a view of a state where the holding frame is positioned in a non-holding position.

DESCRIPTION OF EMBODIMENTS

Hereinafter, a recording apparatus according to an embodiment of the invention will be described with reference to the drawings. The recording apparatus records an image on a recording medium such as T-shirts held in a medium holding section by ejecting ink using an ink jet type recording section.

Moreover, hereinafter, description is given using directions toward "top", "bottom", "left", "right", "front", and "rear" which are illustrated, but these directions are used for the sake of convenience in the description, and embodiments of the invention are not limited to usage of those directions.

As illustrated in FIG. 1, a recording apparatus 1 includes a medium holding section 2 that holds a recording medium M, a substantially rectangular-shaped recording section 3 that is laterally long, and a transport section 5 that transports the medium holding section 2 forward and backward.

The recording section 3 records the image on the recording medium M held in the medium holding section 2. The recording section 3 includes a carriage 7 on which an ink jet head 6 is mounted, and a head moving mechanism (not illustrated) that moves the ink jet head 6 right and left via the carriage 7. The head moving mechanism is configured of a belt mechanism driven by a motor.

The transport section 5 moves the medium holding section 2 between a set position on a front side and a recording start position on a rear side through an entrance 4 provided on the front side of the recording section 3. The transport section 5 is configured of a belt mechanism driven by a motor.

When recording the image on the recording medium M by the recording apparatus 1, first, the user sets the recording medium M in the medium holding section 2 that is moved in the set position. Then, when the recording apparatus 1 receives an instruction of start of recording, the transport section 5 moves the medium holding section 2 from the set position to the recording start position through the entrance 4. Thereafter, the transport section 5 intermittently moves the medium holding section 2 from the recording start position to the front side and the ink jet head 6 faces the recording medium M set in the medium holding section 2, which passes and ejects the ink while reciprocating to the right and left. Thus, the recording apparatus 1 performs a recording operation by which the image is recorded on the recording medium M.

As illustrated in FIGS. 2 to 4, the medium holding section 2 has a tray 11 on which the recording medium M is set, a holding frame 12 that holds the recording medium M together with the tray 11, a tray mounting section 13 on which the tray 11 is mounted on an upper surface thereof, and a base section 14 that supports the tray mounting section 13. The tray 11 is detachably mounted on the tray mounting section 13 and is configured separately from the holding frame 12 and the like.

As illustrated in FIGS. 5A to 5E, in order to correspond to recording media M of various sizes, three types that are different from each other in size, that is, a large tray 11*a*, an intermediate tray 11*b*, and a small tray 11*c* are provided in the tray 11. The tray 11 is not particularly limited, but typically, the large tray 11*a* is used for holding a recording medium M of a relatively large size, the intermediate tray 11*b* is used for holding a recording medium M of an intermediate size, and the small tray 11*c* is used for holding the recording medium M of a relatively small size. For example, vertical and horizontal sizes of each tray body 16 of the large tray 11*a*, the intermediate tray 11*b*, and the small tray 11*c* are respectively 20×28 inches, 16×20 inches, and 14×16 inches.

Moreover, the large tray 11*a* is an example of a "first tray", the intermediate tray 11*b* or the small tray 11*c* being an example of a "second tray".

Furthermore, the medium holding section 2 includes an attachment 15 mounted on the holding frame 12.

A first attachment 15*b* that is mounted on the holding frame 12 if the intermediate tray 11*b* is mounted on the tray mounting section 13, and a second attachment 15*c* that is mounted on the holding frame 12 if the small tray 11*c* is mounted on the tray mounting section 13 are provided in the attachment 15.

The tray 11 includes the tray body 16, two guide sections 17 that are provided in right and left edge portions of a surface opposite to a medium mounting surface 16*a* (described below) of the tray body 16, that is, a lower surface, four tray concave sections 18 (see FIGS. 6A to 6C) that are provided by being dispersed in a rectangular shape at four positions on the lower surface of the tray body 16, and two front and rear positioning pins 19 (see FIGS. 6A to 6C) that are provided at substantially right and left center portions of the lower surface of the tray body 16.

The tray body 16 is configured in a substantially rectangular plate with rounded edges. The upper surface of the tray body 16 is the medium mounting surface 16*a* on which the recording medium M is mounted. In addition, for example, as the recording medium M, if tops such as T-shirts are used, both a front body and a rear body of the tops may be overlappingly mounted on the medium mounting surface 16*a* or one of the front body and the rear body may be mounted on the medium mounting surface 16*a* by wrapping upper and lower portions of the tray 11 by the front body and the rear body.

The tray body 16 may be made of resin such as an acrylic plate and, for example, it is preferable that the tray body 16 is configured of an aluminum plate to ensure rigidity. Thus, when setting the recording medium M on the tray 11, the tray body 16 is prevented from being bent and it is possible to appropriately maintain a gap between the recording medium M mounted on the medium mounting surface 16*a* and the ink jet head 6.

Two right and left guide sections 17 are described below and guide right and left end portions of the recording medium M hanging from the medium mounting surface 16*a*. The guide section 17 is configured of a metal fitting of a substantially crank shape (see FIGS. 6A to 6C) in a cross-sectional view and includes a connection section 21 that comes into contact with the lower surface of the tray body 16, an outer hanging section 22 that is continuous downward from the outside of the connection section 21, a medium receiving section 23 that is continuous from the lower end of the outer hanging section 22 to the outside, and an inner hanging section 20 that is continuous downward from the inside of the connection section 21. Moreover, in the embodiment, the guide sections 17 are provided in the right and left edge portions of the lower surface of the tray body 16, but may be further provided in front and rear edge portions thereof.

The two positioning pins 19 are configured to be longer than the four tray concave sections 18 and are inserted into two positioning holes (not illustrated) provided in the tray mounting section 13 from above until the four tray concave sections 18 abut the upper surface of the tray mounting section 13. Lengths of the four tray concave sections 18 are substantially equal to each other. The tray 11 faces the tray mounting section 13 and is supported at four points of the four tray concave sections 18.

The holding frame 12 is connected to the base section 14 through an assist hinge 43 or a hinge metal fitting 44 (described below) provided in a rear end portion. The holding frame 12 is configured to rotate around an axis of the assist hinge 43 or the hinge metal fitting 44 between a holding position (see FIG. 2) that is a substantially horizontal posture and holds the recording medium M with the tray 11 and a non-holding position (see FIGS. 3 and 4) that is an inclined posture and releases the holding of the recording medium M.

The holding frame 12 includes a rectangular frame-shaped frame body 24, four locking members 25 that are provided in the vicinity of four corners of the frame body 24, and a hinge mounting section 26 which is provided in a rear portion of the frame body 24 and on which the assist hinge 43 or the hinge metal fitting 44 is mounted.

A gap of a size such that the recording medium M is held exists inside a frame of the frame body 24 and the tray body 16 of the large tray 11*a* enters the gap. The frame body 24 is configured by combining an aluminum extruded profile material having a cross section of a substantially inverted trapezoid rectangular shape in a rectangular shape. The frame body 24 includes a front frame member 31, a rear frame member 32, a left frame member 33, and a right frame member 34. An engaging step section 35 engaging with an outer peripheral edge of a plate section 54 (described below) of the attachment 15 is provided in an inside of each upper surface of the front frame member 31, the rear frame member 32, the left frame member 33, and the right frame member 34, that is, in an inner peripheral edge of the upper surface of the frame body 24. Furthermore, a frame-side lock section 36 is mounted on a substantially intermediate portion of the front of the front frame member 31. The hinge mounting section 26 is connected to a rear surface of the rear frame member 32. The locking members 25 are respectively mounted on both front and rear end portions of the left frame member 33 and the right frame member 34 by a rotation pin 37.

Moreover, in the embodiment, the "engaging section" is configured of the engaging step section 35, but is not limited to this configuration, and, for example, the "engaging section" may be a groove formed on an inner surface of the left frame member 33 and the right frame member 34.

A frame-side lock section 36 includes a hook support section 38 that is fixed to the front frame member 31 and a hook member 39 that is rotatably supported by the hook support section 38. The hook member 39 includes a hook section 41 that engages with a base-side lock section 53 described below and a knob section 42 for rotatably operating the hook member 39. The hook member 39 is configured to rotate between a hooked position in which the hook member 39 engages with the base-side lock section 53 and an unhooked position in which engagement of the hook member 39 with the base-side lock section 53 is released, and is biased to rotate to the hooked position by a spring (not illustrated). The user operates the hook member 39 of the frame-side lock section 36 such that it rotates to the unhooked position and releases the engagement of the frame-side lock section 36 with the base-side lock section 53 when operating the holding frame 12 to rotate to the non-holding position.

The four locking members 25 are provided for locking the plate section 54 of the attachment 15 to the frame body 24. Each of the locking members 25 is configured to rotate around the rotation pin 37 between the locked position (see FIGS. 5A to 5E) in which the plate section 54 that is closed on the inside is locked to the frame body 24 and the unlocked position in which the engagement with the plate section 54 that is opened on the outside is released. The user rotates the locking member 25 to the locked position and locks the attachment 15 to the frame body 24 after dropping the attachment 15 to the engaging step section 35 of the frame body 24 in a state where the locking member 25 is positioned in the unlocked position. It is possible to mount the attachment 15 on the holding frame 12 and to separate the attachment 15 from the holding frame 12 by performing a simple operation of rotating the locking member 25 between the locked position and the unlocked position.

The hinge mounting section 26 has a rectangular shape that is laterally long in a top view and has a length in the right-left direction substantially the same as those of the rear frame member 32. The assist hinge 43 is mounted on a substantially intermediate portion of the lower surface of the hinge mounting section 26. The hinge metal fittings 44 are respectively mounted closer to the left side and closer to the right side of the upper surface of the hinge mounting section 26.

The assist hinge 43 includes a substantially flat rectangular parallelepiped fixing section 45 and a movable section 46 rotatably connected to the fixing section 45. The fixing section 45 is fixed to a hinge support section 51 (described below) of the base section 14, and the movable section 46 is fixed to the hinge mounting section 26.

The fixing section 45 and the movable section 46 respectively have covers made of resin. Although not illustrated, a spring for assisting rotation of the holding frame 12 to the non-holding position and a damper for braking the rotation of the holding frame 12 to the holding position are built into the assist hinge 43. Since the rotation of the holding frame 12 to the non-holding position is assisted by the assist hinge 43, the user can easily perform a rotating operation of the holding frame 12 to the non-holding position. Furthermore, since the rotation of the holding frame 12 to the holding position is braked by the assist hinge 43, the user can completely perform the rotating operation of the holding frame 12 to the holding position without fingers being pinched between the holding frame 12 and the large tray 11*a*.

The tray mounting section 13 has a substantially flat rectangular parallelepiped box shape and on which trays 11 of three sizes described above are selectively mounted on the upper surface. Two front and rear positioning holes are formed to pass through a substantially right and left intermediate portion of the tray mounting section 13. The two positioning pins 19 described above pass through the two positioning holes and thereby the tray 11 is mounted in a state of being positioned with respect to the tray mounting section 13. Furthermore, a tilt adjustment mechanism (not illustrated) for adjusting a tilt of the upper surface of the tray mounting section 13 is built into the tray mounting section 13. It is possible to adjust the tilt of the medium mounting surface 16*a* of the tray 11 mounted on the upper surface of the tray mounting section 13 by adjusting the tilt of the upper surface of the tray mounting section 13 by the tilt adjustment mechanism. Thus, it is possible to adjust the gap between a nozzle surface of the ink jet head 6 and the medium mounting surface 16*a* to be substantially uniform in an entire region of the medium mounting surface 16*a*.

The base section 14 includes a substantially prism-shaped base body 47 extending longitudinally, a base concave section 48 protruding upward from a front end portion of the base body 47, a frame section 49 provided on a rearward upper surface of the base body 47 and configured by combining aluminum extrusion members, the plate-shaped hinge support section 51 connected to the rear from a substantially rear intermediate portion of the frame section 49, and a base leg 52 connected to downward from a rearward portion of the base body 47.

The tray mounting section 13 described above is fixed to the upper portion of the base body 47. The base-side lock section 53 having a substantially inverted "L" shape in a side view is fixed to the upper portion of the front surface of the base concave section 48. The base-side lock section 53 engages with the frame-side lock section 36 provided in the holding frame 12 positioned in the holding position. The fixing section 45 of the assist hinge 43 described above is fixed to the upper surface of the hinge support section 51. The base leg 52 is mounted on the transport section 5 described above through a height adjustment mechanism (not illustrated).

The attachment 15 includes the substantially rectangular plate-shaped plate section 54 that is thinner than the tray body 16 and an attachment frame section 55 that is provided on the lower surface of the plate section 54. The outer peripheral edge of the plate section 54 engages with the engaging step section 35 of the frame body 24 described above. Furthermore, a substantially rectangular-shaped attachment opening 56 is formed in the center portion of the plate section 54. A gap sufficient to pinch the recording medium M exists in the attachment opening 56 of the first attachment 15*b* and thereby the tray body 16 of the intermediate tray 11*b* enters the gap. Similarly, a gap sufficient to pinch the recording medium M exists in the attachment opening 56 of the second attachment 15*c* and thereby the tray body 16 of the small tray 11*c* enters the gap.

Furthermore, the attachment 15 is provided with the attachment frame section 55 along an edge portion of the attachment opening 56. The attachment frame section 55 is configured by combining the aluminum extrusion members having cross sections of substantially rectangular shapes in rectangular shapes. When the user mounts the attachment 15 on the holding frame 12, the attachment frame section 55 faces a side opposite to the medium mounting surface 16*a* of the tray body 16, that is, faces downward in a state where the holding frame 12 is positioned in the holding position.

Here, an operation procedure of a case where the recording media M are sequentially set to the intermediate tray 11*b*, the large tray 11*a*, and the small tray 11*c* and an image is recorded by the recording apparatus 1 will be described.

Moreover, in a state before the operation, the tray 11 is not mounted on the tray mounting section 13, the attachment 15 is not mounted on the holding frame 12, and the holding frame 12 is positioned in the holding position.

First, the user operates the holding frame 12 such that it rotates to non-holding position. Then, the user mounts the intermediate tray 11*b* on the tray mounting section 13. Then, the user mounts the recording medium M on the medium mounting surface 16*a* of the intermediate tray 11*b*. Furthermore, the user mounts the first attachment 15*b* on the holding frame 12.

Then, the user operates the holding frame 12 on which the first attachment 15*b* is mounted such that it rotates from the non-holding position to the holding position. Thus, the recording medium M is held between the edge portion of the attachment opening 56 of the first attachment 15*b* and the outer peripheral edge of the intermediate tray 11*b*. At this time, the frame-side lock section 36 engages with the base-side lock section 53 and the holding frame 12 is locked in the holding position. Thus, after the recording medium M is set to the medium holding section 2 on which the intermediate tray 11*b* is mounted, the user instructs starting of the recording with the recording apparatus 1.

After the recording is performed on the recording medium M, the user operates the holding frame 12 such that it rotates from the holding position to the non-holding position. Then, the user removes the recording medium M on which the image is recorded from the medium holding section 2.

Then, the intermediate tray 11*b* and the large tray 11*a* are exchanged. That is, the intermediate tray 11*b* is removed from the tray mounting section 13 and, instead, the large tray 11*a* is mounted on the tray mounting section 13. Then, the user mounts the recording medium M on the medium mounting surface 16*a* of the large tray 11*a*.

Furthermore, the user separates the first attachment 15*b* from the holding frame 12.

Then, the user operates the holding frame 12 that is separated from the first attachment 15*b* such that it rotates from the non-holding position to the holding position. Thus, the recording medium M is held between the inner peripheral edge of the holding frame 12 and the outer peripheral edge of the large tray 11*a*. Thus, after the recording medium M is set on the medium holding section 2 on which the large tray 11*a* is mounted, the user instructs starting of the recording with the recording apparatus 1.

After the recording is performed on the recording medium M, the user operates the holding frame 12 such that it rotates from the holding position to the non-holding position. Then, the user removes the recording medium M on which the image is recorded from the medium holding section 2.

Then, the user exchanges the large tray 11*a* and the small tray 11*c*. That is, the large tray 11*a* is removed from the tray mounting section 13 and, instead, the small tray 11*c* is mounted on the tray mounting section 13. Then, the user mounts the recording medium M on the medium mounting surface 16*a* of the small tray 11*c*. Furthermore, the user mounts the second attachment 15*c* on the holding frame 12.

Then, the user operates the holding frame 12 that is mounted on the second attachment 15*c* such that it rotates from the non-holding position to the holding position. Thus, the recording medium M is held between the edge portion of the attachment opening 56 of the second attachment 15*c* and the outer peripheral edge of the small tray 11*c*. Thus, after the recording medium M is set on the medium holding section 2 on which the small tray 11*c* is mounted, the user instructs starting of the recording with the recording apparatus 1.

After the recording is performed on the recording medium M, the user operates the holding frame 12 such that it rotates from the holding position to the non-holding position. Then, the user removes the recording medium M on which the image is recorded from the medium holding section 2.

Moreover, the order of the procedure is not limited to the embodiment and phases may be mixed in a range in which there is no interference with the work.

As described above, according to the medium holding section 2 of the embodiment, since the large tray 11*a*, the intermediate tray 11*b*, and the small tray 11*c* are configured to be separate bodies from the holding frame 12, the user can perform mutual exchange of the large tray 11*a*, the intermediate tray 11*b*, and the small tray 11*c* as a single body of the tray 11. Thus, the user can easily perform the exchange work of the tray 11. Then, the user can hold the recording medium M between the large tray 11*a* and the holding frame 12 by mounting the large tray 11*a* on the tray mounting section 13 and separating the attachment 15 from the holding frame 12. Furthermore, the user can hold the recording medium M between the intermediate tray 11*b* and the first attachment 15*b* by mounting the intermediate tray 11*b* on the tray mounting section 13 and mounting the first attachment 15*b* on the holding frame 12. Similarly, the user can hold the recording medium M between the small tray 11*c* and the second attachment 15*c* by mounting the small tray 11*c* on the tray mounting section 13 and mounting the second attachment 15*c* on the holding frame 12.

Moreover, the user may appropriately apply a processing solution to increase fixability of the ink to the recording medium M held in the medium holding section 2 using a spray and the like before the instruction is made to start the recording after the recording medium M is set on the medium holding section 2. At this time, as described above, since the assist hinge 43 has the cover, the processing solution is prevented from being applied to the inside of the assist hinge 43 and it is possible to suppress damage to the assist hinge 43 by the processing solution.

Furthermore, according to the embodiment, since the same holding frame 12 is shared for the large tray 11*a*, the intermediate tray 11*b*, and the small tray 11*c*, it is possible to reduce the number of frame-side lock sections 36 or the assist hinges 43 without it being necessary to provide a frame-side lock section 36 or an assist hinge 43 for each holding frame 12 as in a case where separate holding frames 12 are used for the large tray 11*a*, the intermediate tray 11*b*, and the small tray 11*c*.

Furthermore, according to the embodiment, the guide sections 17 of the large tray 11*a* guide the end portions of the recording medium M on the outside of the tray body 16 when the recording medium M is held between the large tray 11*a* and the holding frame 12 and thereby the end portions of the recording medium M hanging from between the tray body 16 of the large tray 11*a* and the frame body 24 of the holding frame 12 become substantially "L" shaped due to the medium receiving section 23 (see FIG. 6A). Thus, it is possible to increase a contact area between the tray body 16, the holding frame 12, and the recording medium M. Thus, if the recording medium M is held between the large tray 11*a* and the holding frame 12, wrinkles of the held recording medium M are extended and it is possible to prevent the recording medium M from moving after the recording medium M is held. Furthermore, since the gap is provided between the outer hanging section 22 of the guide section 17 and the frame body 24, it is possible to release the held recording medium M being tensioned by the pin.

Furthermore, the guide sections 17 of the intermediate tray 11*b* guide the end portions of the recording medium M on the outside of the tray body 16 when the recording medium M is held between the intermediate tray 11*b* and the first attachment 15*b* and thereby the end portions of the recording medium M hanging from between the tray body 16 of the intermediate tray 11*b* and the attachment frame section 55 of the first attachment 15*b* become substantially "L" shaped due to the medium receiving section 23 (see FIG. 6B). Thus, it is possible to increase the contact area between the tray body 16, the attachment frame section 55, and the recording medium M. The same configuration is applied to the guide section 17 of the small tray 11*c* (see FIG. 6C). Thus, even if the recording medium M is held between the intermediate tray 11*b* and the first attachment 15*b* or the recording medium M is held between the small tray 11*c* and the second attachment 15*c*, it is possible to create a similar situation to the case where the recording medium M is held between the large tray 11*a* and the holding frame 12. Thus, even if the recording medium M is held between the intermediate tray 11*b* and the first attachment 15*b*, or the recording medium M is held between the small tray 11*c* and the second attachment 15*c*, the held recording medium M or the wrinkles of the held recording medium M are extended and it is possible to prevent the recording medium M from moving after the recording medium M is held. Furthermore, also for the guide section 17 of the intermediate tray 11*b* or the small tray 11*c*, since the gap is provided between the outer hanging section 22 and the attachment frame section 55, it is possible to release the held recording medium M to be tensioned with the pin.

Moreover, for a thick recording medium M such as sweatshirts, the recording medium M may not be pinched between the large tray 11*a* and the holding frame 12, between the intermediate tray 11*b* and the first attachment 15*b*, or between the small tray 11*c* and the second attachment 15*c*. In such a case, as illustrated in FIG. 7, the intermediate tray 11*b* is mounted on the tray mounting section 13, the attachment 15 is separated from the holding frame 12, and end portions of the thick recording medium M hanging from the medium mounting surface 16*a* of the intermediate tray 11*b* enter between the intermediate tray 11*b* and the holding frame 12. Furthermore, although not specifically illustrated, the small tray 11*c* is mounted on the tray mounting section 13, the first attachment 15*b* is mounted on the holding frame 12, and the end portions of the thick recording medium M hanging from the medium mounting surface 16*a* of the small tray 11*c* may enter between the small tray 11*c* and the first attachment 15*b*. Thus, it is possible to set the thick recording medium M on the medium holding section 2. In this case, even if the recording medium M is not sufficiently held, since the recording medium M can be fitted to the inside of the holding frame 12, it is possible to prevent the end portions of the recording medium M from being caught in the transport path by the transport section 5 in the recording operation.

Next, a modified example of a medium holding section 2 will be described. The medium holding section 2 of the modified example is substantially the same configuration as the medium holding section 2 described above, but is different from the medium holding section 2 described above in that gas springs 61 are provided instead of the assist hinge 43. Moreover, the description regarding the medium holding section 2 described above applies equally to the medium holding section 2 of the modified example unless otherwise specified.

As illustrated in FIGS. 8 and 9, the medium holding section 2 of the modified example includes two gas springs 61 on both right and left sides of a holding frame 12. Frame-side connection sections 62 to which one end of each gas spring 61 is connected are formed in rearward portions of a left frame member 33 and a right frame member 34 of the holding frame 12.

Furthermore, a frame support section 63 is provided in a rear end portion of a base section 14 instead of the frame section 49 and the hinge support section 51 described above. Hinge sections 64 that rotatably support the holding frame 12 are provided in right and left rear end portions of the frame support section 63. Base-side connection sections 65 to which the other end of the gas springs 61 are connected protrude from right and left front end portions of the frame support section 63.

Similar to the assist hinge 43 described above, two gas springs 61 provided as described above assist rotation of the holding frame 12 to a non-holding position and brake rotation of the holding frame 12 to a holding position.

As described above, the medium holding section 2 of the embodiment includes the assist hinge 43 or the gas spring 61, and thereby it is possible to improve operability when rotating the holding frame 12 between the holding position and the non-holding position. Furthermore, in a case where the assist hinge 43 is used, it is possible to mount the assist hinge 43 closer to a rotation shaft of the holding frame 12 than in a case where the gas spring 61 is used. Thus, even if the assist hinge 43 is not provided in both end portions of the holding frame 12 in a direction of the rotation shaft, that is, in the right and left both end portions, but is provided in a substantially intermediate portion of the holding frame 12 in the direction of the rotation shaft, that is, a substantially right and left intermediate portion as the embodiment, for a rotation base end portion of the holding frame 12 on which the assist hinge 43 is mounted, that is, the hinge mounting section 26, it is possible to reduce dimensions in a direction perpendicular to the direction of the rotation shaft, that is, in the forward and rearward direction and it is possible to reduce the size of the holding frame 12.

Moreover, the assist hinge 43 and the gas spring 61 are an example of the "brake assist section".

The recording medium M is not particularly limited, but, for example, a fabric can be appropriately used and clothes such as T-shirts can particularly preferably used.

Furthermore, a configuration using the medium holding section 2 used in the recording apparatus 1 is disclosed, but the configuration is not limited to the embodiment. The medium holding section 2 may be used in a transport apparatus that transports the medium in addition to the recording apparatus and the medium holding section 2 may be used as a medium holding device for use in a cutting plotter.

REFERENCE SIGNS LIST

2 Medium holding section
11*a* Large tray
11*b* Intermediate tray
11*c* Small tray
12 Holding frame
13 Tray mounting section
15*b* First attachment

15*c* Second attachment
16*a* Medium mounting surface
M Recording medium

The invention claimed is:

1. A medium holding device comprising:

a tray mounting section configured to selectively mount thereon a first tray and a second tray, the first tray having a medium mounting surface and the second tray having a medium mounting surface smaller than that of the first tray;

a holding frame that is separately configured from the first tray and the second tray, and is configured to hold a recording medium mounted on the medium mounting surface of the first tray with the first tray if the first tray is mounted on the tray mounting section; and an attachment that is mounted on an inside of the holding frame and is configured to hold the recording medium mounted on the medium mounting surface of the second tray with the second tray if the second tray is mounted on the tray mounting section, wherein the holding frame includes a hook member configured to rotate between a hooked position that locks the holding frame, and an unhooked position that releases the holding frame, and wherein the hook member is biased to rotate to the hooked position by a spring.

2. The medium holding device according to claim 1, further comprising:

a base section that supports the tray mounting section, wherein the holding frame is provided in the base section to be rotatable between a holding position in which the recording medium is held and a non-holding position in which the holding of the recording medium is released.

3. The medium holding device according to claim 2, further comprising:

a frame-side lock section that is provided in the holding frame and includes the hook member, and a base-side lock section that is provided in the base section and engages with the frame-side lock section of the holding frame positioned in the holding position.

4. The medium holding device according to claim 2, further comprising:

a brake assist section that is mounted on the holding frame and brakes rotation of the holding frame to the holding position and assists rotation of the holding frame to the non-holding position.

5. The medium holding device according to claim 4, wherein the brake assist section is configured of an assist hinge rotatably connecting the holding frame to the base section.

6. The medium holding device according to claim 1, wherein the first tray has a tray body in which one surface of front and rear surfaces is the medium mounting surface, and a guide section that is provided in an edge portion of a surface opposite to the medium mounting surface of the tray body and guides an end portion of the recording medium hanging from between the tray body and the holding frame to the outside with respect to the tray body.

7. The medium holding device according to claim 1, wherein the attachment has a plate section provided with an opening, and an attachment frame section that is provided along an edge portion of the opening in one surface of the front and rear surfaces of the plate section, and wherein the second tray has a tray body in which one surface of the front and rear surfaces is the medium mounting surface, and a guide section that is provided in the edge portion of the surface opposite to the medium mounting surface of the tray body and guides the end portion of the recording medium hanging from between the tray body and the attachment frame section to the outside with respect to the tray body.

8. The medium holding device according to claim 1, wherein the holding frame has a frame body in which an engaging section engaging with an outer peripheral edge of the attachment is provided in an inner peripheral edge, and a locking member that is provided in the frame body to be movable between a locked position in which the attachment engaged with the engaging section is locked to the frame body and an unlocked position in which the locking of the attachment is released.

9. A recording apparatus comprising:

the medium holding device according to claim 1; and a recording section that records an image to the recording medium held by the medium holding device.

10. The medium holding device according to claim 1, wherein the hook member is provided in a center of front of the holding frame.

11. The medium holding device according to claim 1, wherein the holding frame includes a locking member configured to rotate between a locked position in which locks the attachment, and an unlocked position in which releases the attachment, and wherein a direction in which the holding frame rotates and a direction in which the locking member rotates are different.

* * * * *